US005927016A

United States Patent [19]

Börgen

[11] Patent Number: 5,927,016

[45] Date of Patent: Jul. 27, 1999

[54] DOOR CLOSURE ASSEMBLY

[75] Inventor: Arden L. Börgen, Des Moines, Iowa

[73] Assignee: Margaret Platt Borgen, Des Moines, Iowa

[21] Appl. No.: 08/975,739

[22] Filed: Nov. 21, 1997

[51] Int. Cl.[6] ..... E05F 11/24

[52] U.S. Cl. ..... 49/346; 49/339; 49/123

[58] Field of Search ..... 49/333, 334, 335, 49/346, 138, 116, 117, 118, 339, 340

[56] References Cited

U.S. PATENT DOCUMENTS

| | | | |
|---|---|---|---|
| 2,758,835 | 8/1956 | Wikkerink | 49/138 X |
| 2,808,256 | 10/1957 | Landert | 49/138 X |
| 4,365,442 | 12/1982 | Speer | 49/346 |
| 5,392,562 | 2/1995 | Carambula | 49/346 |
| 5,452,543 | 9/1995 | VonWald et al. | 49/346 |

FOREIGN PATENT DOCUMENTS

| | | | |
|---|---|---|---|
| 2527843 | 1/1977 | Germany | 49/346 |
| 354692 | 7/1961 | Switzerland | 49/346 |

*Primary Examiner*—Jerry Redman
*Attorney, Agent, or Firm*—Zarley, McKee, Thomite, Voorhees & Sease

[57] ABSTRACT

A door closure system for one or more swinging doors includes, in its most basic form, a door closure assembly for a door pivotally mounted on a hinge axis in a door frame. The assembly includes a closure mechanism mounted on the door frame adjacent the door with a rotatable member extending therefrom, an elongated arm having a secured end fixed for rotation with a rotatable member and a free end extending alongside the door, and a roller wheel rotatably mounted on the free end of the arm and extending therefrom so as to overlap the door for engaging it and rolling about a wheel axis substantially parallel to the hinge axis when the door swings about the hinge axis from a first pivotal position to a second pivotal position. This door closure assembly can also be applied to a double swinging door by adding more closure mechanisms and interconnecting them for the desired synchronization. A stop for holding the door open to a set position can also be provided.

17 Claims, 5 Drawing Sheets

10
10
11
11
32
38
54A
52A
58
20
56
66A
60
62
68
70
76
74
72
34
36
40
42
48
80
64
62
60
42
66A
56
76
68
72
70
74
58
54A
52A
44
44
32
38
20
34
28
28
60
66A

DOOR CLOSURE ASSEMBLY

BACKGROUND OF THE INVENTION

1. Field Of The Invention

The present invention relates to a closure system for swinging doors.

2. Problems In The Art

The problem of controlling pivotally or swingably mounted doors is an old and persistent one. It is often difficult to simultaneously control certain variables as the door opens or closes. Among these variables are: speed of opening, speed of closing, deceleration forces on opening or closing, and, in the case of double doors, synchronizing the movement of two doors simultaneously. These problems are particularly troublesome when the swinging door or doors are glass doors which provide access to a cooled display case. Such doors need to open and close quickly to avoid allowing the cool air inside the case to escape, however, damage can result if the doors close too quickly or are abruptly decelerated. Existing closure mechanisms and systems do not provide the opportunity to adjust the necessary variables in order to effectively control the doors. Therefore, there is a need for an improved door closure system and mechanism to overcome these shortcomings.

FEATURES OF THE INVENTION

A primary object of the present invention is the provision of an improved door closure system and mechanism for controlling one or more swingable doors.

A further object of the present invention is the provision of an improved door closure system for a cooled display case.

A further object of the present invention is the provision of a door closure assembly mounted on the door frame adjacent the door and having a pivotal closure arm, a roller wheel rotatably mounted on the arm such that the roller wheel engages the door and rolls about a wheel axis substantially parallel to the hinge axis when the door swings about the hinge axis.

A further object of the present invention is the provision of a closure mechanism whose speed is adjustable so as to control the speed of the door(s).

A further object of the present invention is the provision of a door closure assembly that has a stop mechanism for propping a door open to a set position.

A further object of the present invention is the provision of a door closure assembly which does not need to be secured to the door.

A further object of the present invention is the provision of a door closure system that is adaptable to single and double swinging doors.

A further object of the present invention is the provision of a door closure system for a double swinging door wherein the movement of the doors can be controlled and coordinated or synchronized.

A further object of the present invention is the provision of an adjustable dampening mechanism for controlling the deceleration of the door(s).

These and other objects will be apparent to one skilled in the art from the drawings, the description which follows, and the claims.

SUMMARY OF THE INVENTION

The present invention relates to a door closure system for one or more swinging doors including, in its most basic form, a door closure assembly for a door pivotally mounted on a hinge axis in a door frame. The assembly includes a closure mechanism mounted on the door frame adjacent the door with a rotatable member extending therefrom, an elongated arm having a secured end fixed for rotation with a rotatable member and a free end extending alongside the door, and a roller wheel rotatably mounted on the free end of the arm and extending therefrom so as to overlap the door for engaging it and rolling about a wheel axis substantially parallel to the hinge axis when the door swings about the hinge axis from a first pivotal position to a second pivotal position.

This door closure assembly can also be applied to a double swinging door. In that case, synchronizing means interconnect the first and second closure mechanisms to coordinate the swinging of the doors.

DETAILED DESCRIPTION OF THE PREFERRED EMBODIMENT

Figure 1:
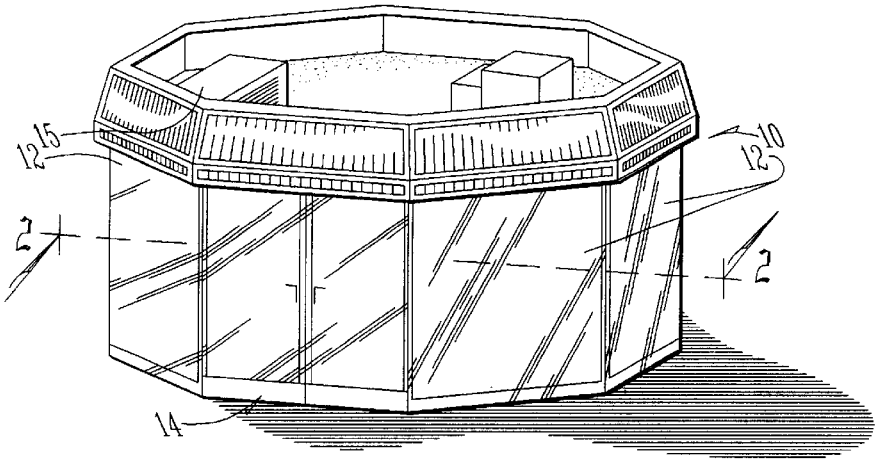
FIG. 1 is a perspective view of a cooled display case which has swinging doors equipped with the door closure system of the present invention.

Referring to FIG. 1, a cooled display case or enclosure 10 includes a plurality of sides 12, preferably constructed of glass or other transparent materials. Some of the sides 12 meet at a doorway 14. The interior of the case or enclosure 10 is cooled by a conventional cooler 15.

Figure 2:
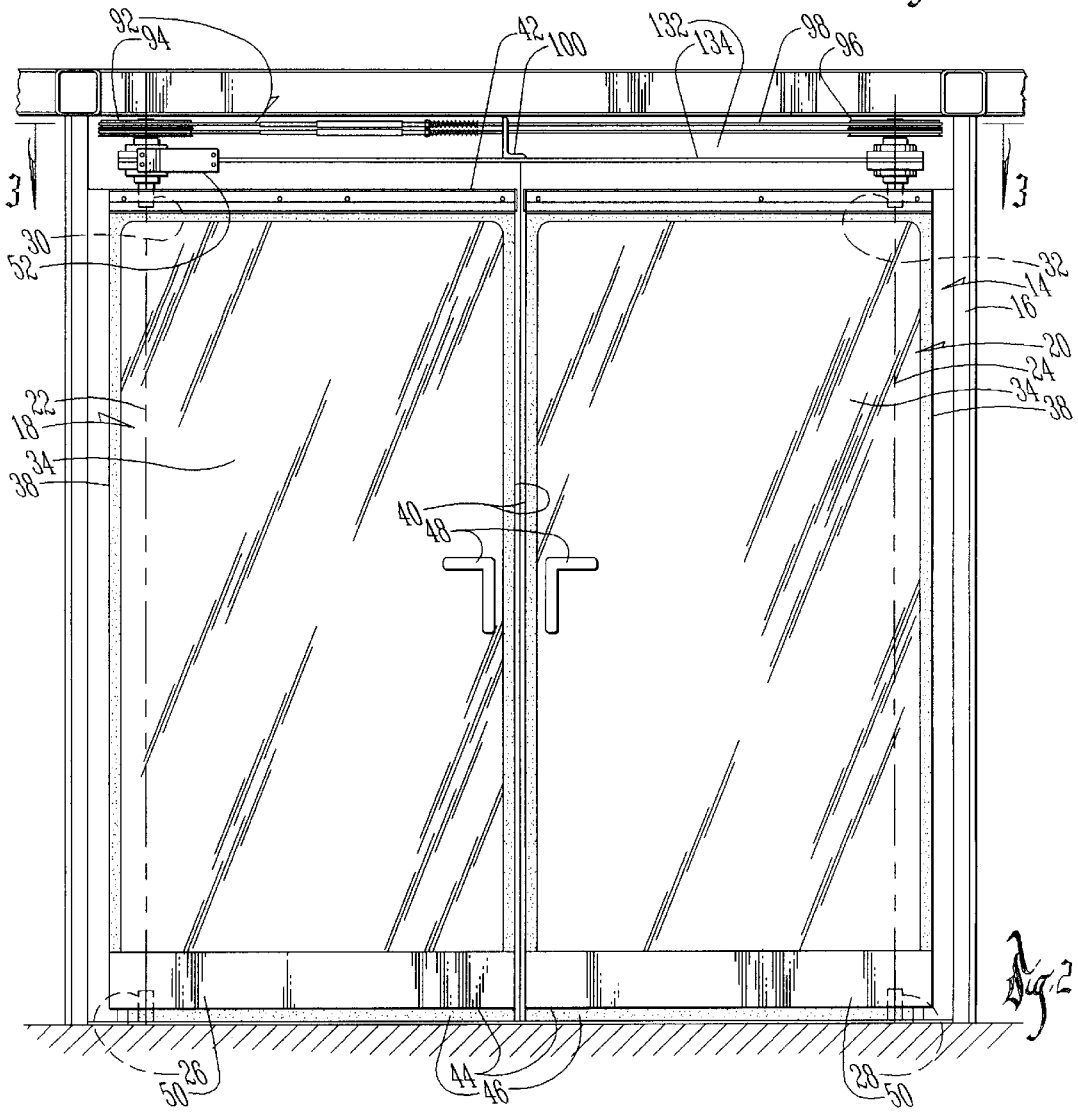
FIG. 2 is a front elevation view taken along line 2—2 of FIG. 1 and shows double swinging doors equipped with the door closure system of the present invention.

FIG. 2 reveals that the doorway 14 has a door frame 16 wherein a first door 18 (left) and a second door 20 (right) are pivotally mounted on respective first and second hinge axes 20, 24. The first door 18 pivots or swings about a lower hinge shaft 26 and carries the upper hinge shaft 30 with it (see FIG. 5). Similarly, the second door 20 pivots or swings about a lower hinge shaft 28 and carries an upper hinge shaft 32 with it.

Preferably, the doors 18, 20 are constructed of glass or other suitably transparent materials which allow one to view the products on display inside the case 10 from the outside. Each of the doors 18, 20 include opposing faces 34, 36 (FIG. 3), side edges 38, 40, and top and bottom edges 42, 44 respectively. In FIG. 2, a sealing member 46 extends downwardly from the bottom edge 44 of each door 18, 20. Optional handles 48 and kickplates 50 can be provided on the doors 18, 20.

The basic door closure assembly of this invention is applied to one or more of the doors 18, 20 described above. A closure mechanism 52 (FIGS. 2–7), 52A (FIGS. 8–9) mounts on the door frame 16 adjacent the door 18 or 20. The closure mechanism 52, 52A is preferably hydraulic or pneumatic and has a rotatable member 54, 54A extending therefrom. Such closure mechanisms are available from Ryobi America of Anderson, S.C., USA, under part number BD85SSL. As best seen in FIGS. 6 and 9, an elongated arm 56 has a secured end 58 fixed for rotation with the rotatable member 54, 54A. The arm 56 also has a free end 60 which extends alongside the door 18 or 20. The term "alongside", as used herein, means along any one of the edges (38, 40, 42, 44) or faces (34, 36).

Figure 10:
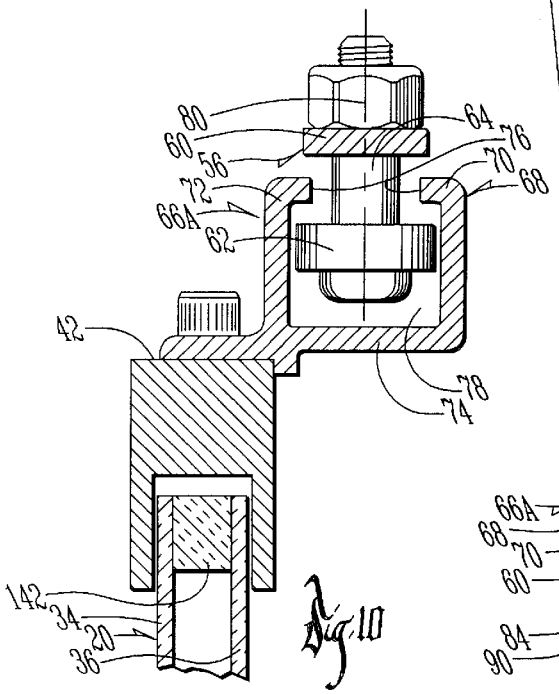
FIG. 10 is an enlarged cross-sectional view taken along line 10—10 of FIG. 8 and shows the channel-shaped raceway with the roller wheel disposed therein.

A roller wheel 62 rotatably mounts on the free end 60 of the arm 56. The roller wheel 62 can be mounted for rotation about a roller extension rod 64 that is secured to the free end 60 of the arm 56 by conventional means (see FIGS. 9–10). Thus, the roller wheel 62 is rotatably mounted and positioned so as to overlap the door 18 or 20 or an extension thereof. In FIG. 6, the roller wheel 62 engages a raceway 66 mounted on one of the faces 34, 36 of the door 18, 20 adjacent its top edge 42. It is contemplated that the door closure mechanism 52A could be positioned at the bottom of the door 18, 20 without detracting significantly from the invention.

In FIGS. 8–11, the raceway 66A is mounted as an extension of the door 18, 20. The raceway 66A includes a channel-shaped portion 68 which has a pair of spaced apart legs 70, 72 extending from a base 74. The legs 70, 72 jut inwardly above the base 74 to form an elongated gap therebetween. Furthermore, an elongated opening is formed between the legs 70, 72 and the base 74. The opening 78 is slightly larger than the diameter of the roller wheel 62, such that the roller wheel 62 can roll along the inside surfaces of the legs 70, 72. However, the gap 76 is smaller than the diameter of the roller wheel 62 so as to effectively retain it within the raceway 66A, at least in the direction of the roller extension rod 64. It will be understood by those skilled in the art that the position of the channel-shaped raceway 66A can be altered to match the orientation of the roller wheel 62, and vice versa.

Figure 3:
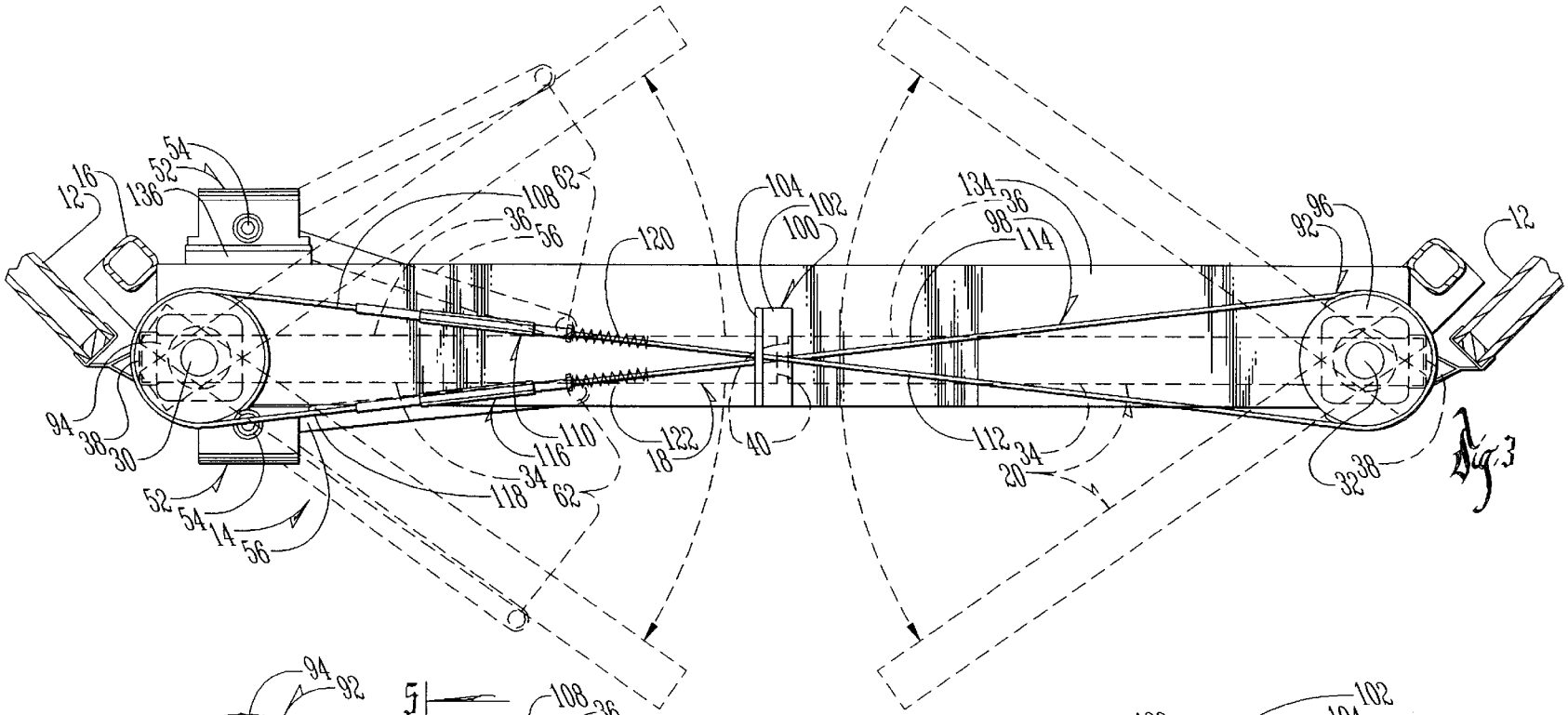
FIG. 3 is a top view of the door closure system of the present invention taken along line 3—3 in FIG. 2 (door closure mechanisms are shown engaging both faces of one of the doors).

Preferably, the roller wheel 62 rolls about a wheel axis 80 that is substantially parallel to the hinge axis 22, 24 when the door 18, 20 swings from a first pivotal position to a second pivotal position. Urged by the closure mechanism 52, 52A, the roller wheel 62 engages the door to control its rate of opening or closing. The closure mechanism 52, 52A of the present invention is extremely versatile. The closure mechanism 52, 52A is applicable to a single door, or a double swinging door combination. Furthermore, a single closure mechanism 52, 52A can be used on each door, or a second closure mechanism 52, 52A can be used on the opposite side of the door. FIG. 3 illustrates the application of two closure mechanisms 52 on a single door 18.

Figure 12:
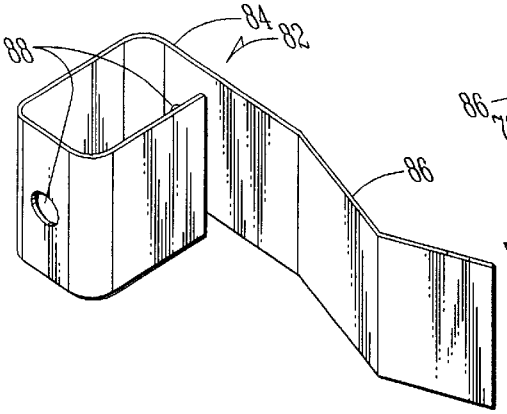
FIG. 12 is a perspective view of the stop bracket shown in FIG. 11.
Figure 11:
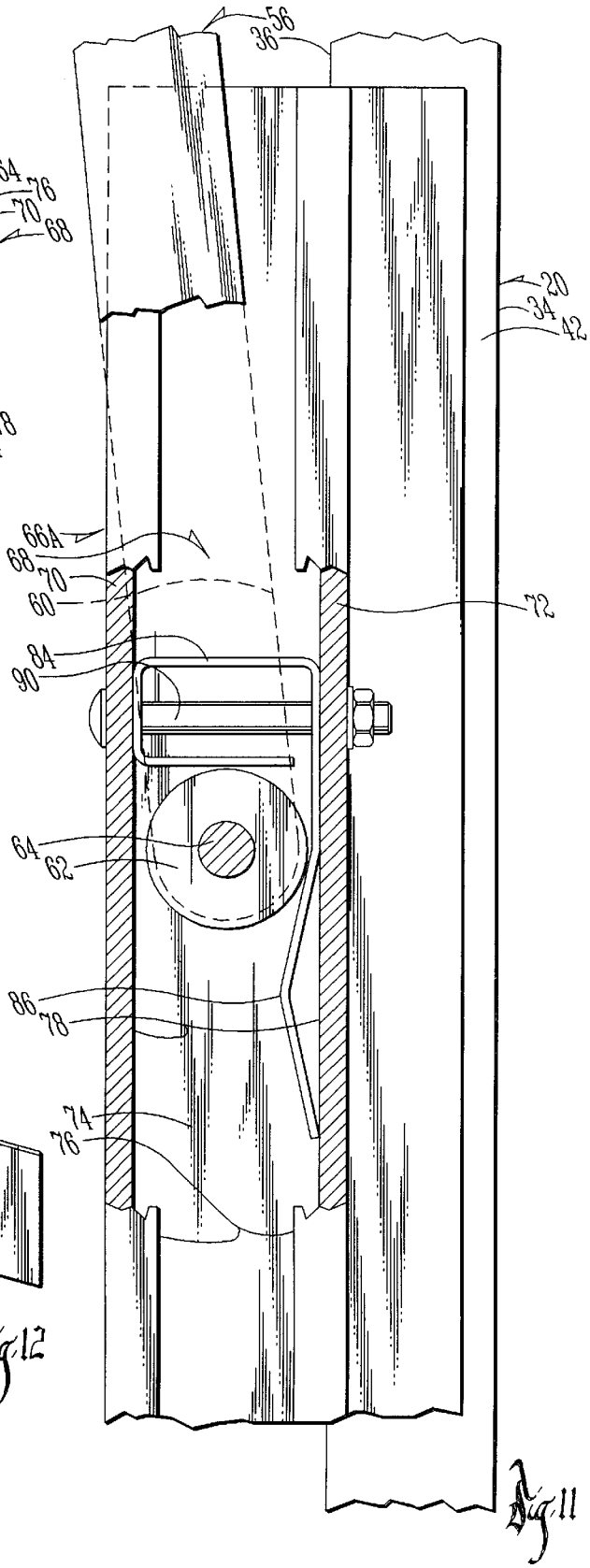
FIG. 11 is an enlarged and partially broken away view of the area designated in 11—11 in FIG. 8, which exposes the raceway, the stop member disposed therein and the roller wheel captured thereby to put the door in a set position.

In the embodiment shown in FIGS. 8–12, a means for stopping the door 18, 20 in a set position is provided. FIG. 12 shows a q-shaped stop member 82, which is preferably formed of a thin sheet of steel or other bendable material. The stop member 82 has a looped portion 84 and a leaf spring portion 86 extending therefrom. The leaf spring portion 86 has a raised or elevated intermediate section to provide the desired spring characteristics. The loop portion 84 has a hole 88 therethrough for mounting the stop member 82 in the channel-shaped raceway 66A as shown in FIG. 11. The roller wheel 62 depresses the leaf spring portion 86 after entering the stop member 82 from the left in FIG. 11. After the roller wheel 62 passes over the intermediate section of the leaf spring 86, the intermediate section springs back to its original position so that the roller wheel 62 is retained in the stop member 82 in the absence of outside forces. The roller wheel 62 is stopped from rolling any farther to the right. The looped portion 84 of the stop member 82 prevents the roller wheel 62 from rolling any farther to the right. The stop member 82 is held in place in the raceway 66A by conventional fastening or attaching means 90. When a leftward force sufficient to overcome the leaf spring 86 is applied to the door 18, 20, the wheel 62 will escape and roll freely within the raceway 66A again. The door will close.

A synchronizing means 92 interconnects the first and second closure mechanisms to coordinate their movement, and thus the movement of the doors 18, 20. The synchronizing means 92 includes a pulley 94 mounted on the first hinge axis 22 and secured to the door 18 so as to rotate therewith. A second pulley 96 is rotatably mounted on the second hinge axis 28 and secured to the door 20 so as to rotate or pivot therewith. A cable 98 has one end secured to the pulley 94 and another end secured to the pulley 96. An L-shaped stop member 100 having a base 102 mounted approximately midway between the first and second pulleys 94, 96 has an upright leg 104 with an aperture 106 therein for allowing the cable 98 to pass through. The cable 98 crosses itself, preferably adjacent the stop member 100.

Figure 4:
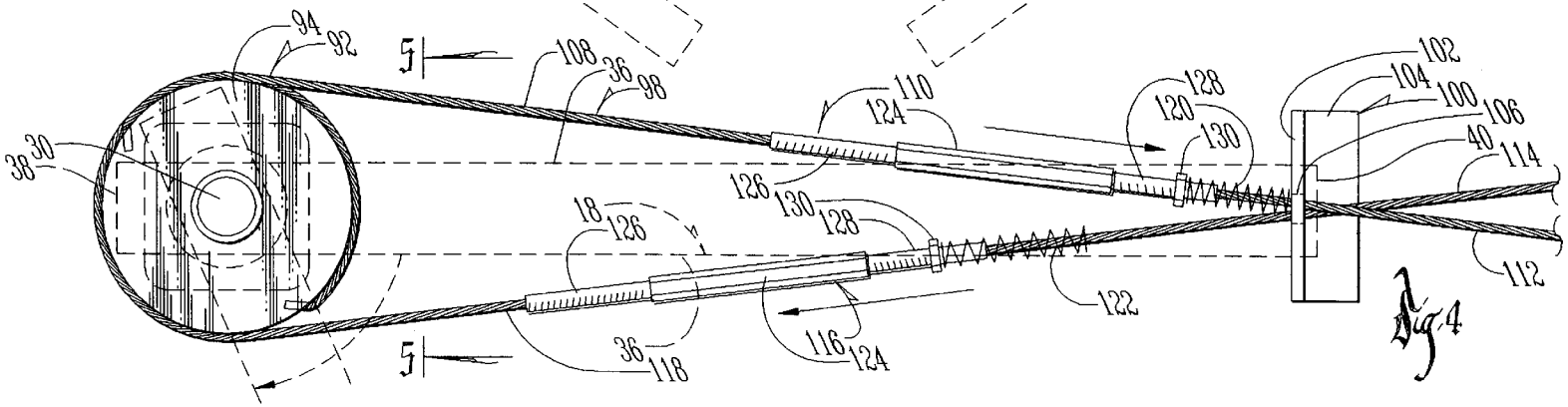
FIG. 4 is an enlarged view of the pulley, cable and adjustable dampening mechanisms of the present invention.

Preferably, the cable 98 includes four sections (see FIGS. 3 and 4). A first section 108 has one end attached to the first pulley 94 and another end attached to an adjustable length turnbuckle 110. A second section 112 has one end attached to the adjustable length turnbuckle 110 and another end attached to the second pulley 96. A third section 114 has one end attached to the pulley 96 and the other end attached to another adjustable length turnbuckle 116. A fourth section 118 has one end attached to the pulley 94 and another end attached to the other end of the turnbuckle 116. Thus, the cable configuration resembles the Arabic numeral eight.

Springs 120, 122, each having an inside diameter larger than the cable 98, are mounted on the second and third sections 112, 114 of the cable 98. Springs 120, 122 are preferably of the coil compression type. The springs 120, 122 are interposed between the respective turnbuckles 110, 116 and the stop member 100, as shown in FIGS. 3 and 4.

As best seen in FIG. 4, the turnbuckles 110, 116 each include a central, internally threaded member 124, which has an outside configuration adapted to be turned with a wrench. A first male threaded portion 126 is crimped or otherwise firmly attached to the cable 98 and threadably inserted into the internally threaded member 124. A similar second male threaded portion 128 is crimped or otherwise firmly attached to the cable 98 and threadably inserted into the internally threaded member 124. Threaded portion 128 has a shoulder 130 disposed opposite the internally threaded member 124. The shoulder 130 provides a seat or stop for one end of the spring 120, 122. Of course, if the diameter of the second male threaded portion 128 is larger than the outside diameter of the spring 120, 122, the shoulder 130 does not need to project any farther outward.

This turnbuckle arrangement has a couple of advantages. First, the turnbuckles 110, 116 allow the length of the cable 98 to be adjusted so as to provide proper tension thereon between the pulleys 94, 96. More importantly, the turnbuckles 110, 116 provide a way to vary exactly when the springs 120, 122 contact the stop member 100 and begin dampening the movement of the swinging doors 18, 20.

The springs 120, 122 contact the stop member 100 (aperture 106 is small enough to ensure that the springs do not pass through), and are compressed between the stop plate 100 and the shoulder 130 of the portion 128 of the turnbuckle 110, 116. This dampens the movement of the doors 18, 20. Such dampening is particularly useful when the doors 18, 20 are nearing their fully closed positions. However, it is contemplated that the spring dampening mechanism could be applied at the opening limit of the door as well.

Figure 7:
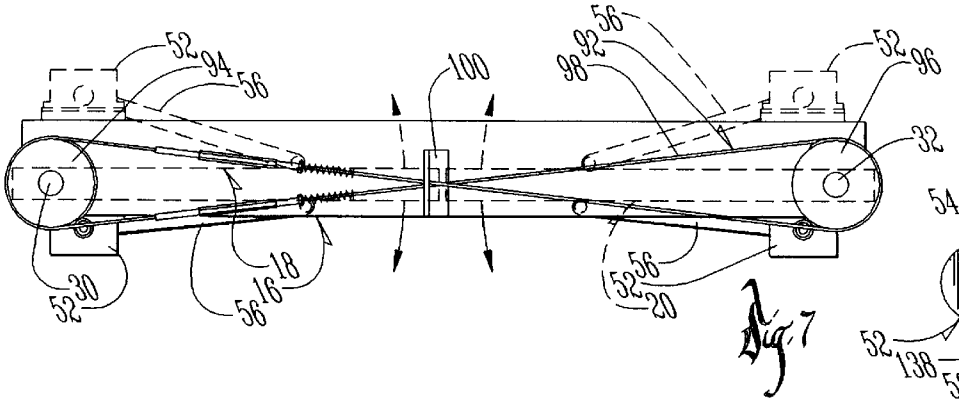
FIG. 7 is a top view of the door closure system of this invention with one or more door closure mechanisms applied to each of a pair of the adjacent swinging doors.
Figures 8, 9:
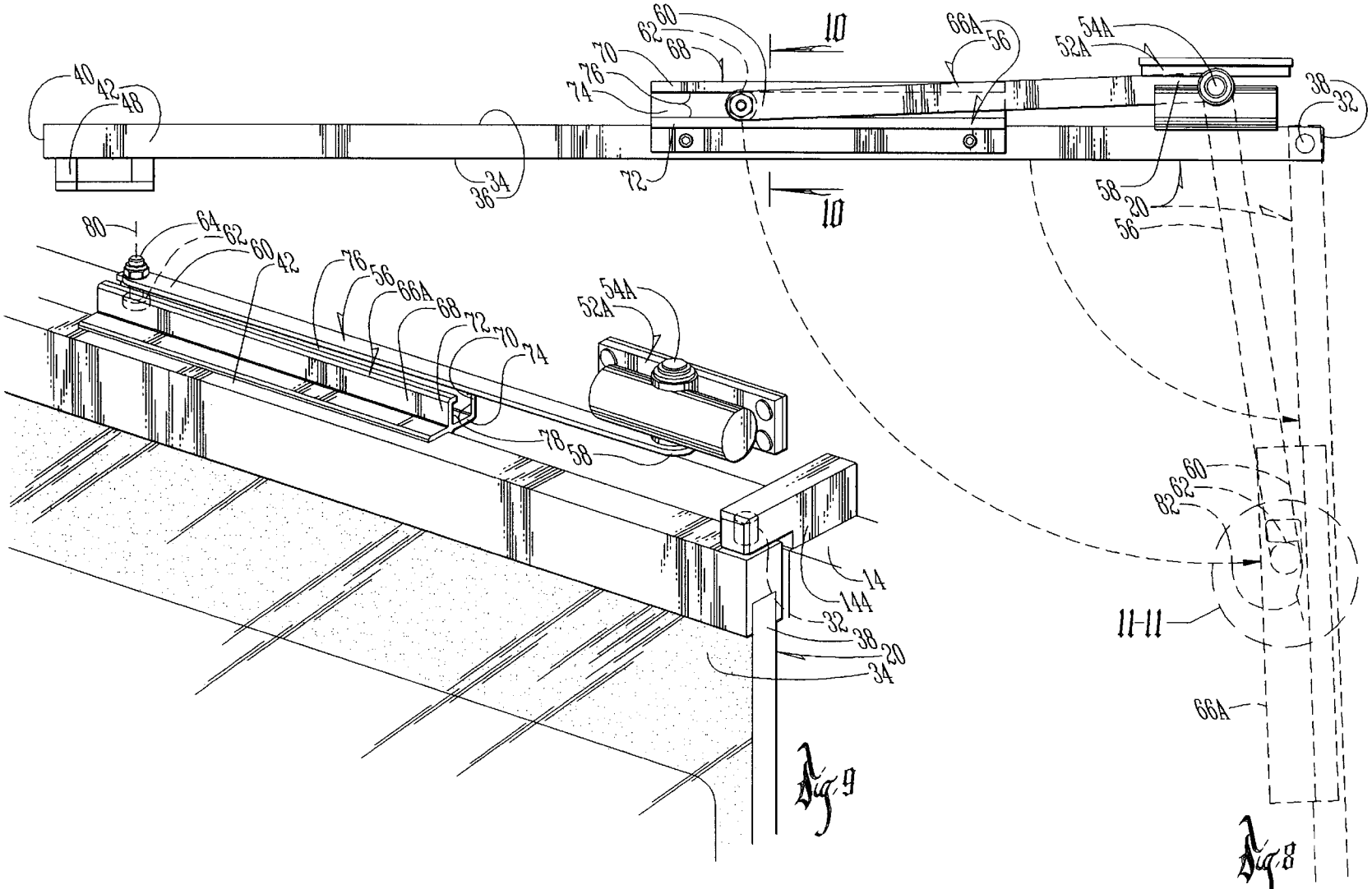
FIG. 8 is a top view of another embodiment of the present invention wherein the raceway is channel-shaped and has a spring operated stop member for holding the door in a set open position in the absence of outside forces.
FIG. 9 is a perspective view of the closure system and stop member of FIG. 8.

FIG. 7 shows in solid lines that two closure mechanisms can be applied to the same side of a pair of swinging doors. Furthermore, an additional two closure mechanisms 52 can also be applied to the opposite side or face of the doors 18, 20, either alternately or in conjunction therewith. One skilled in the art will also appreciate that a single closure mechanism 52 can be applied to one door 18. In that case, the pulleys 94, 96 would be optional.

Figure 5:
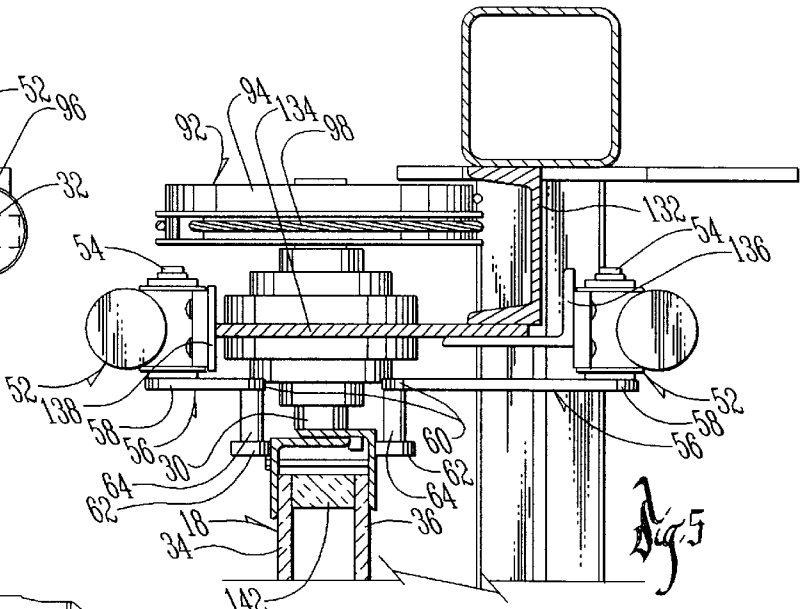
FIG. 5 is a view taken along line 5—5 in FIG. 4 and shows the mounting of the various door closure system components near the hinge axis.
Figure 6:
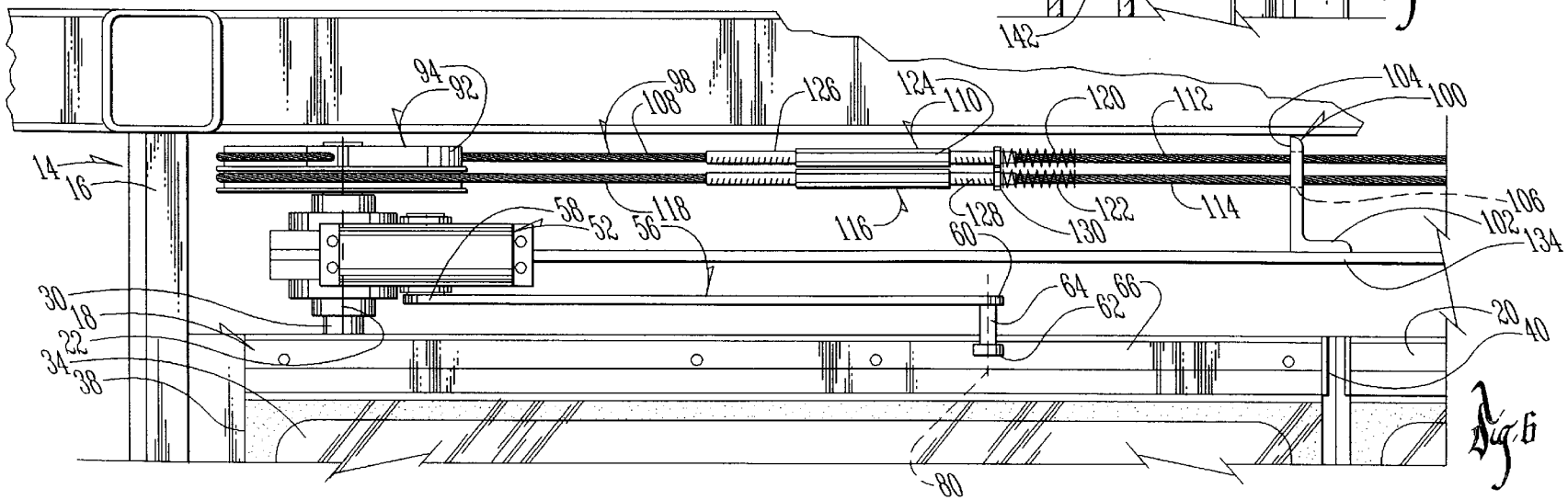
FIG. 6 is an enlarged front elevation view which includes the door closure system of this invention and the top of the doors. This figure illustrates the engagement of the roller wheel engaging a raceway provided on the face of the door adjacent its edge.

FIG. 5 shows the mounting of the door 18 and the closure system to the door frame 16. A C-shaped header beam 132 is welded or otherwise conventionally attached to the door frame 16. A guide plate 134 is welded or otherwise attached to the lower end of the header 132 and extends transversely across the doorway 14. The guide plate 134 has holes (not shown) near either of its ends for guidingly receiving and pivotally mounting the pivotal portions of the closure system.

As can be seen in FIG. 6, the stop member 102 attaches to the guide plate 134. Referring again to FIG. 5, one or more closure mechanisms are mounted to the guide plate 134. An L-shaped bracket 136 has one of its legs welded to the guide plate 134 opposite the header 132. The other leg of the bracket 136 provides a mounting surface for the closure mechanism 52. Another door closure mechanism 52 can be mounted to a bracket 138 which is welded or otherwise suitably attached to the guide plate 134. Preferably, the bracket 138 extends perpendicular to the guide plate 134.

The upper hinge shaft 30 is rigidly attached to one of the L-shaped raceways 66 which sandwich the door 18 therebetween. Therefore, the shaft 30 moves with the door 18 and pivots with respect to the guide plate 134 and the frame 16. The door 18 includes two panes of glass 34, 36 separated by a spacer 142 of insulating and sealing material.

In the embodiment of FIG. 9, the shaft 30 can be attached to the door 20 and rotate within the pivot guide 144. Alternately, the shaft 30 can be fixed in the guide 144 and the door 20 can pivot thereabout.

From the foregoing, it can be seen that the present invention is quite versatile. The closure mechanism of this invention can be applied to one or both sides of a single door or one or both sides of a double swinging door. The closure mechanisms 52, 52A are adjustable for closing speed and force. The adjustable dampening mechanism of the present invention further refines the movement of the door or doors.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A door closure assembly comprising in combination:

a door frame;

a door pivotally mounted in the door frame for pivotal movement about a hinge axis;

a closure mechanism mounted on the door frame adjacent the door and having a rotatable member extending therefrom;

an elongated arm having a secured end fixed for rotation with the rotatable member of the closure mechanism and a free end extending alongside the door;

a roller wheel rotatably mounted on the free end of the arm and extending therefrom so as to overlap the door for resistively engaging the door and rolling about a wheel axis substantially parallel to the hinge axis when the door swings about the hinge axis from a first pivotal position to a second pivotal position;

a raceway mounted on the door;

the roller wheel slide rollingly engaging the raceway;

the raceway being a channel-shaped member having a base portion and opposing legs extending therefrom defining a gap smaller than the roller wheel and an opening between the legs for receiving the roller wheel;

a generally 1-shaped retaining member having a looped portion and a leaf spring portion extending therefrom, the retaining member being mounted in the raceway so as to yieldingly retain the roller wheel between the looped portion and the leaf spring and thereby hold the door in a set position until an outside force urges the roller wheel from the set position and over the leaf spring portion.

2. The door closure assembly of claim 1 wherein the wheel axis is parallel to the rotatable member.

3. The door closure assembly of claim 2 wherein the wheel axis and the hinge axis are generally vertical.

4. The door closure assembly of claim 1 wherein the closure mechanism is hydraulic.

5. The door closure assembly of claim 1 wherein the closure mechanism is adjustable such that the rotatable member rotates at variable speeds.

6. The door closure assembly of claim 1 wherein the door is open in the first pivotal position and closed in the second pivotal position.

7. The door closure assembly of claim 1 wherein the door has opposing faces, opposing side edges, and opposing top and bottom edges; the raceway being mounted on one of the opposing faces adjacent the top edge.

8. The door closure assembly of claim 7 further comprising a second raceway mounted on the other of the opposing faces of the door adjacent the top edge and a second door closure assembly for engaging the second raceway.

9. The door closure assembly of claim 1 wherein the door is formed of glass.

10. The door closure assembly of claim 1 wherein the arm and the roller wheel swing out of engagement with the door without using tools.

11. A door closure assembly comprising in combination:

a door frame;

a door mounted within said door frame for pivotal movement about a door axis from a closed position to an open position;

a closure mechanism mounted on said door frame adjacent said door;

an elongated arm connected to said closure mechanism for swinging movement about an arm axis;

a roller wheel rotatably mounted to said arm at a point spaced from said arm axis;

an elongated guide member mounted to said door and having an elongated guide member axis, said guide member retentively guiding said roller wheel for rolling movement along said guide member axis during swinging movement of said door between said open and said closed positions;

said closure mechanism yieldably urging said elongated arm in a first pivotal direction about said arm axis to cause said door to be yieldably urged to said closed position;

a stop member connected to said guide member in a position wherein said stop member retentively engages said roller wheel when said door is in said open position.

12. A door closure assembly according to claim 11 wherein said stop member is adapted to release said roller wheel from retentive engagement in response to a predetermined outside force being applied to said door to urge said door to said closed position.

13. A door closure assembly according to claim 12 wherein said stop member comprises a spring and a wheel engaging member, said roller wheel engaging said wheel engaging member and moving said wheel engaging member to a release position during movement of said door to said open position, said spring yieldably moving said wheel engaging member to a retaining position retentively engaging said wheel when said door is in said closed position.

14. A door closure assembly according to claim 13 wherein said spring yields and permits said wheel engaging member to move to said release position in response to said door being moved from said open position toward said closed position by an outside force of predetermined magnitude.

15. A door closure assembly according to claim 14 wherein said guide member comprises and elongated track, said roller wheel being within said track and rolling along the length of said track during movement of said door between said open and said closed positions.

16. A door closure assembly according to claim 15 wherein said spring and said wheel engaging member are mounted within said track.

17. A door closure assembly according to claim 16 wherein said spring comprises a leaf spring, and said wheel engaging member comprises a portion of said leaf spring.

* * * * *